US010112093B2

(12) United States Patent
Peebles

(10) Patent No.: US 10,112,093 B2
(45) Date of Patent: Oct. 30, 2018

(54) BATTING STANCE TRAINING MAT

(71) Applicant: Ralph Bodie Peebles, West Wendover, NV (US)

(72) Inventor: Ralph Bodie Peebles, West Wendover, NV (US)

( * ) Notice: Subject to any disclaimer, the term of this patent is extended or adjusted under 35 U.S.C. 154(b) by 2 days.

(21) Appl. No.: 15/665,772

(22) Filed: Aug. 1, 2017

(65) Prior Publication Data

US 2018/0050249 A1 Feb. 22, 2018

Related U.S. Application Data

(60) Provisional application No. 62/377,243, filed on Aug. 19, 2016.

(51) Int. Cl.
*A63B 69/00* (2006.01)
*A63B 71/06* (2006.01)

(52) U.S. Cl.
CPC .. *A63B 69/0002* (2013.01); *A63B 2069/0008* (2013.01); *A63B 2071/0694* (2013.01); *A63B 2208/12* (2013.01)

(58) Field of Classification Search
USPC ..... 473/218, 225, 422, 450, 452, 458, 464
See application file for complete search history.

(56) References Cited

U.S. PATENT DOCUMENTS 3,979,116 A * 9/1976 Matchick ..... A63B 69/0002 434/247
5,330,176 A * 7/1994 Cagney, Jr. ..... A63B 69/0002 473/452
5,536,004 A 7/1996 Wiseman et al.
5,947,833 A 9/1999 Alward
7,090,599 B2 8/2006 Hedgepath
D634,385 S * 3/2011 Parrish ..... D21/780
8,226,504 B1 7/2012 Lozado
2001/0036869 A1* 11/2001 Grabowski ..... A63B 69/3667 473/270
2005/0143200 A1* 6/2005 Hedgepath ..... A63B 69/0002 473/452
2006/0258486 A1* 11/2006 Hedgepath ..... A63B 69/0002 473/452
2011/0098136 A1 4/2011 Maresh
2013/0337928 A1* 12/2013 Scott ..... A63B 69/3667 473/218

* cited by examiner

*Primary Examiner* — Nini Legesse
(74) *Attorney, Agent, or Firm* — Global Intellectual Property Agency, LLC; Daniel Boudwin

(57) ABSTRACT

The present invention provides a batting stance training mat for teaching a proper batting stance. The batting stance training mat comprises a center panel, a first lateral panel, a second lateral panel, and an end panel. The center panel includes a home plate indicia that designates home plate. The first lateral panel and the second lateral panel each contain a plurality of indicia that designate foot placement of a user relative to the home plate indicia on the center panel. The end panel includes an indicia that designates foot placement of a second user relative to the home plate indicia. A plurality of fasteners are located on an outer perimeter of the device. In an alternative embodiment, each lateral panel contains three indicia, wherein each indicia on the lateral panels and the indicia on the end panel are pairs of shoe prints.

7 Claims, 3 Drawing Sheets

BATTING STANCE TRAINING MAT

CROSS REFERENCE TO RELATED APPLICATION

This application claims the benefit of U.S. Provisional Application No. 62/377,243 filed on Aug. 19, 2016. The above identified patent application is herein incorporated by reference in its entirety to provide continuity of disclosure.

BACKGROUND OF THE INVENTION

The present invention relates to baseball training mats. More specifically, the present invention provides a batting stance training mat for properly positioning a user when striking a ball with a bat.

Teaching young children the mechanics of how to hit a baseball or softball can be difficult due to the required body positioning and coordination. Proper foot placement within a batter's box is necessary for learning how to hit a baseball. Most children learning to swing a bat require a coach to continually position and reposition their feet near a tee or home plate. Once a child swings the bat, the child often forgets exactly where their feet are supposed to be positioned while hitting. The coach then must attend to the child and reposition their feet, which detracts from other responsibilities of the coach. Therefore, a training mat having indicia for designating proper foot placement while in a batting stance is needed.

Devices have been disclosed in the known art that relate to baseball training mats. These include devices that have been patented and published in patent application publications. These devices generally relate to baseball training aids and softball training aids for positioning the feet of a user when in a batting stance.

These known art devices have several known drawbacks. Some devices do not include indicia on both sides of the training mat for designating a left-handed and right-handed batting stance. Some training mats fail to include different sets of indicia for positioning a batter in order to hit balls to different directions in relation to a baseball field, such as left field, center field, and right field. Further, some devices do not include an indicia on an end panel used to position foot placement of a second user, such as a catcher, coach or umpire. Finally, some training mats fail to include indicia shaped as foot prints that designate proper foot placement for a user.

In light of the devices disclosed in the known art, it is submitted that the present invention substantially diverges in design elements from the known art and consequently it is clear that there is a need in the art for an improvement to existing baseball training mats. In this regard the instant invention substantially fulfills these needs.

SUMMARY OF THE INVENTION

In view of the foregoing disadvantages inherent in the known types of baseball training mats now present in the known art, the present invention provides a new batting stance training mat wherein the same can be utilized for providing convenience for the user when properly positioning the feet of a user when striking a ball with a bat.

It is therefore an object of the present invention to provide a new and improved batting stance training mat that has all of the advantages of the known art and none of the disadvantages.

It is another object of the present invention to provide a batting stance training mat comprising, a center panel, a first lateral panel, a second lateral panel, and an end panel. The center panel has a home plate indicia for designating home plate. The first lateral panel and the second lateral panel each have a plurality of indicia for designating foot placement of a user relative to the home plate indicia on the center panel. The end panel has an indicia for designating foot placement of a second user relative to the home plate indicia. The batting stance training mat further comprises a plurality of fasteners on an outer perimeter thereof.

Another object of the present invention is to provide a batting stance training mat wherein each lateral panel has three indicia, such that a first indicia is positioned between a first terminal end of each lateral panel and a first side of the home plate indicia, a second indicia is positioned between the first side and a second side of the home plate indicia, and a third indicia is positioned between the second side of the home plate indica and a second terminal end of each lateral panel.

Another object of the present invention is to provide a batting stance training mat wherein the three indicia on each lateral panel and the indicia on the end panel are all pairs of shoe prints.

Yet another object of the present invention is to provide a batting stance training mat, wherein the first terminal end of each lateral panel extends outwardly past the first end of the center panel and the plurality of fasteners are stake and hole fasteners.

Another object of the present invention is to provide a batting stance training mat that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
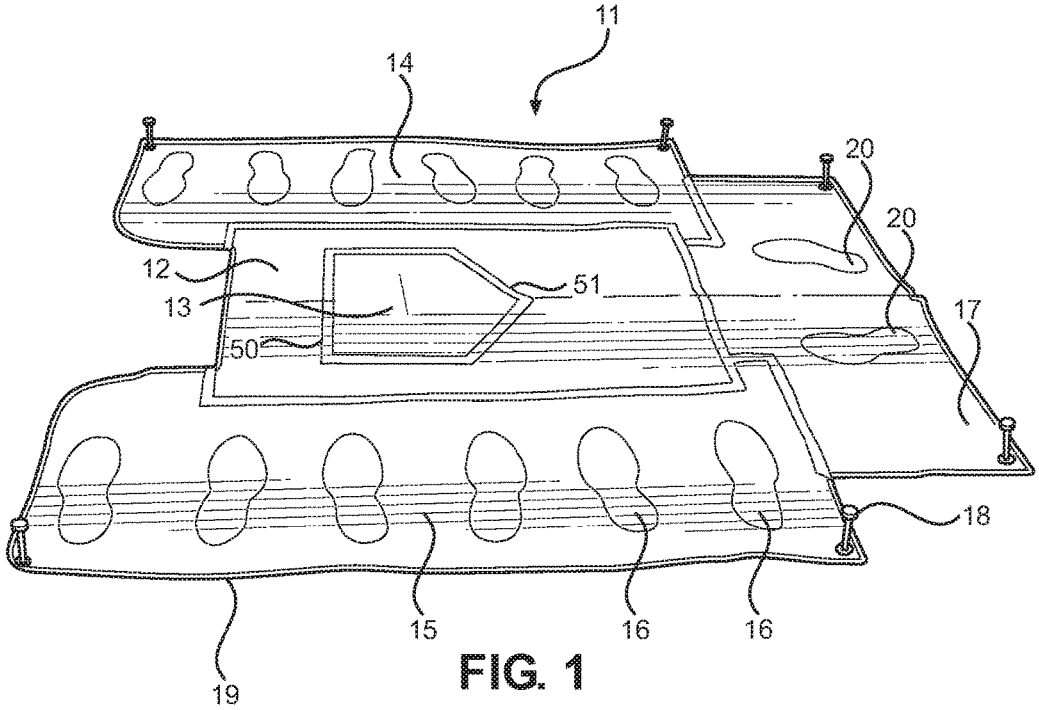
FIG. 1 shows a perspective view of the batting stance training mat.

Reference is made herein to the attached drawings. Like reference numerals are used throughout the drawings to depict like or similar elements of the batting stance training mat. For the purposes of presenting a brief and clear description of the present invention, the preferred embodiment will be discussed as used for properly positioning the feet of a user when striking a ball. The figures are intended for representative purposes only and should not be considered to be limiting in any respect.

Referring now to FIG. 1, there is shown a perspective view of the batting stance training mat. The batting stance training mat 11 comprises a center panel 12, with a home plate indicia 13 for designating home plate, a first lateral panel 14, and a second lateral panel 15. The home plate indicia 13 includes a first side 50 and a second side 51 that oppose each other, wherein the second side contains an apex. Each lateral panel 14, 15 has a plurality of indicia 16 thereon, wherein each indicia 16 designates foot placement of a user relative to the home plate indicia 13 on the center panel 12. The device 11 further includes an end panel 17 having an indicia 20 designating foot placement of a second user relative to the home plate indicia 13.

The batting stance training mat 11 further includes a plurality of fasteners 18 on an outer perimeter 19 of the device 11. In the illustrated embodiment, the plurality of fasteners 18 are stake and hole fasteners. The stake and hole fasteners 18 are configured to secure the outer perimeter 19 of the batting stance training mat 11 to a ground, such as a surface of a batter's box on a baseball field. When secured to the surface of the batter's box, the home plate indicia 13 on the center panel 12 is configured to overlay home plate. However, the training mat 11 can be placed on and secured to any suitable ground, such a beach or a grass field. The batting stance training mat 11 is constructed of polymeric material, such as polyethylene fiber. This material allows the training mat 11 to be easily rolled up and placed in a storage configuration. This material further provides durability to the batting stance training mat 11, such that the mat is configured to withstand repeated contact with the feet of the user when in operation.

Figure 2:
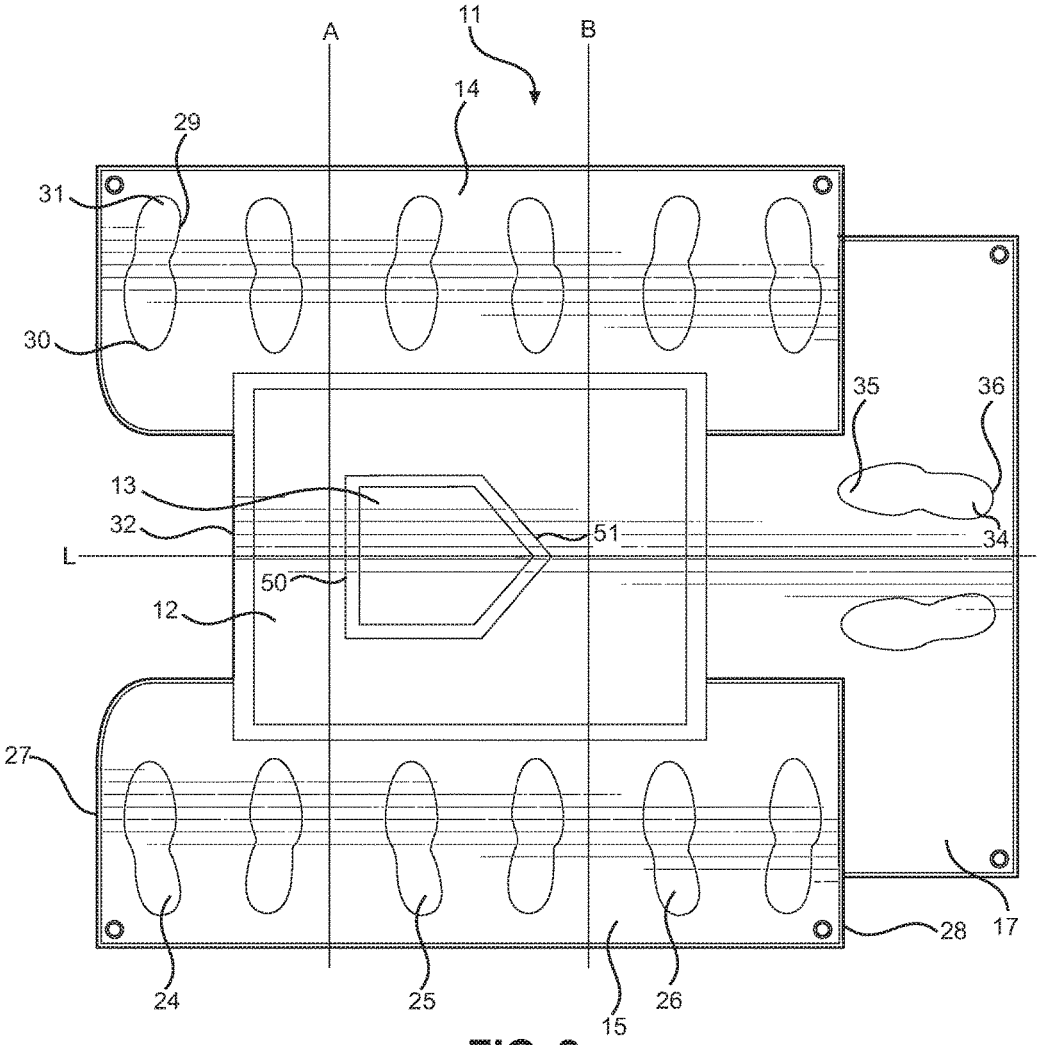
FIG. 2 shows a top view of the batting stance training mat.

Referring now to FIG. 2, there is shown a top view of the batting stance training mat. In the illustrated embodiment, the first terminal end 27 of each lateral panel 14, 15 extends outwardly past a first end 32 of the center panel 12. This configuration allows a first indicia 24 on each lateral panel 14, 15 to be positioned past the home plate indicia 13 on the center panel 12. In the illustrated embodiment, an A axis, a B axis, and a longitudinal axis overlay the batting stance training mat 11 to show the positioning of the indicia on the device. The A axis and B axis are positioned on opposing sides of the home plate indicia 13, such that the A axis is positioned between the first end 32 of the center panel 12 and the first side 50 of the home plate indicia 13, the B axis is positioned between the second side 51 of home plate indicia 13 and a second end of the center panel 12, wherein both the A and B axes run parallel to the first end 32 of the center panel and each A and B axis intersects the longitudinal axis L of the center panel 12.

In the illustrated embodiment, the first lateral panel 14 and the second lateral panel 15 each have three indicia, such that the first indicia 24 is positioned between a first terminal end 27 of each lateral panel 14, 15 and the A axis, a second indicia 25 is located between the A axis and B axis on each lateral panel 14, 15, and a third indicia 26 is located between the B axis and a second terminal end 28 on each lateral panel 14,15.

In the illustrated embodiment, the three indicia 24, 25, 26 on each lateral panel 14, 15 are configured as pairs of shoe prints 29, wherein each shoe print 29 has a toe end 30 and heel end 31. The toe end 30 of each shoe print 29 faces toward an opposing lateral panel. Further, the indicia on the end panel 17 is configured as a pair of shoe prints 34, wherein each shoe print has a toe end 35 and heel end 36, wherein the toe end 35 of each shoe print faces toward the center panel 12.

The three indicia 24, 25, 26 on the lateral panels 14, 15 are used to position the feet of a user that has a left handed or right handed swing when using a bat. The first lateral side 14 is configured for a user having a left handed swing, while the second lateral side 15 is configured for a user having a right handed swing. Further, when the batting stance training mat 11 is placed over home plate on a baseball field, positioning the feet of a user on a specific indicia will designate a direction a ball will travel on the field when struck by a bat.

Standing on the second lateral panel 15 with feet positioned in the first indicia 24, the second indicia 25, or the third indicia 26, will allow a right handed user to strike a ball positioned over the home plate indicia 13 to right field, center field, or left field, respectively. The ball is positioned over the home plate indicia 13 via a tee ball stand or a thrown pitch. Standing on the first lateral panel 14, with feet positioned in the first indicia 24, the second indicia 25, or the third indicia 26, will allow a left handed user to strike a baseball positioned over the home plate indicia 13 to left field, center field, or right field, respectively. This configuration allows the user to work on different batting angles by positioning their feet in different indicia in relation to the home plate indicia 13 on the mat 11.

In the illustrated embodiment, the indicia on the end panel 17 are shoe prints 34. The shoe prints 34 are used to designate the foot placement of a second user, such as an umpire, coach, or a catcher. These shoe prints 34 allow the second user to comfortably position their feet to catch a pitched ball or re-tee a ball on a tee ball stand that is placed over the home plate indicia 13. Further, having the second user standing on these shoe prints 34 allows the first user standing in one of the three indicia 24, 25, 26 on either lateral side 14, 15 to become comfortable when batting with someone behind home plate, similar to real time game conditions.

Figure 3:
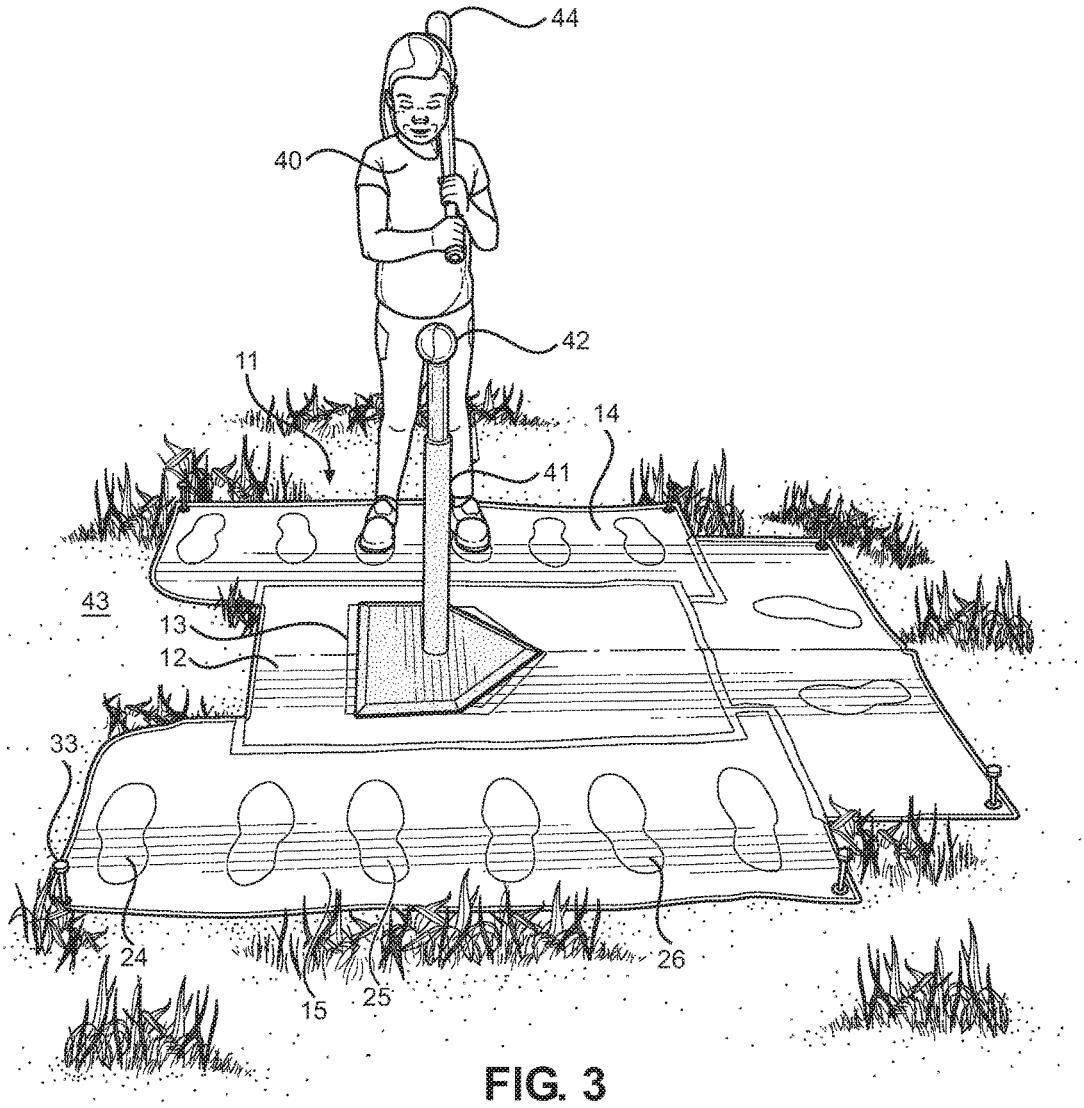
FIG. 3 shows a perspective view of the batting stance training mat, wherein a tee ball stand is placed over a home plate indicia on the center panel.

Referring now to FIG. 3, there is shown a perspective view of the batting stance training mat, wherein a tee ball stand is placed over a home plate indicia on the center panel. In the illustrated embodiment, the batting stance training mat 11 is secured over home plate on a baseball field 43 by utilizing a plurality of stake and hole fasteners 33. The fasteners 33 prevent the batting stance training mat 11 from moving or bunching when a user 40 swings a bat 44 and further pivots their feet. This prevents the mat 11 from having to be repositioned after each swing.

In the illustrated embodiment, a tee ball stand 41 is placed over the home plate indicia 13 of the center panel 12. The tee ball stand 41 positions the ball 42 directly over the home plate indicia 13, wherein the user 40 can hit the ball when positioning their feet in one of the indicia 24, 25, 26 located on the lateral panels 14, 15. As shown, the feet of the user are positioned in the second indicia 25 on the first lateral side 14. This position allows the user having a left handed swing to hit the ball 42 off of the tee 41 to center field.

In an alternative embodiment, the batting stance training mat 11 further comprises indicia on each lateral panel that are color coded, such that the first indicia 24 is a first color, the second indicia 25 is a second color, and the third indicia 26 is a third color. In an alternative embodiment, the first color is red, the second color is green, and the third color is blue. However, the indicia can be any color. This color coding further provides a visual indication to the user to help reinforce which direction the ball will travel when struck from a swing from a specific pair of indicia.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A batting stance training mat comprising:

a center panel with a home plate indicia for designating home plate;

a first lateral panel and a second lateral panel each having a first terminal end and a second terminal end, wherein each lateral panel includes a plurality of indicia, wherein each of the plurality of indicia designates foot placement of a user relative to the home plate indicia;

an end panel having an indicia designating foot placement of a second user relative to the home plate indicia;

wherein the end panel extends past the second terminal end of each of the first and second lateral panel;

wherein the indicia of the end panel is a pair of shoe prints, wherein each shoe print has a toe end and heel end, wherein the toe end of each shoe print faces toward and is centrally aligned with the center panel;

a plurality of fasteners on an outer perimeter of the batting stance training mat.

2. The batting stance training mat of claim 1, wherein the first lateral panel and the second lateral panel each have three indicia, such that a first indicia is positioned between the first terminal end of each lateral panel and a first side of the home plate indicia, a second indicia is located between the first side of the home plate indicia and a second side of the home plate indicia, and a third indicia is located between the second side of the home plate indicia and the second terminal end of each lateral panel.

3. The batting stance training mat of claim 2, wherein the first indicia, second indicia, and third indicia on each lateral panel are pairs of shoe prints, wherein each shoe print has a toe end and heel end, wherein the toe end of each pair of shoe prints faces toward an opposing lateral panel.

4. The batting stance training mat of claim 2, wherein each indicia on each lateral panel is color coded, such that the first indicia is a first color, the second indicia is a second color, and the third indicia is a third color.

5. The batting stance training mat of claim 1, wherein the first terminal end of each lateral panel extends outwardly past a first end of the center panel.

6. The batting stance training mat of claim 1, wherein the plurality of fasteners are stake and hole fasteners.

7. The batting stance training mat of claim 1, wherein the mat is made of a polymeric material.

* * * * *